US007025234B2

(12) United States Patent
Priebe et al.

(10) Patent No.: US 7,025,234 B2
(45) Date of Patent: Apr. 11, 2006

(54) APPARATUS AND METHOD FOR DISPENSING HIGH-VISCOSITY LIQUID

(75) Inventors: Ryan Priebe, Allen, TX (US); Kevin T. O'Dougherty, Arden Hills, MN (US); Nicholas Cheesebrow, St. Paul, MN (US)

(73) Assignees: Advanced Technology Materials, Inc., Danbury, CT (US); Texas Instruments, Inc., Dallas, TX (US)

( * ) Notice: Subject to any disclaimer, the term of this patent is extended or adjusted under 35 U.S.C. 154(b) by 314 days.

(21) Appl. No.: 10/247,107

(22) Filed: Sep. 19, 2002

(65) Prior Publication Data

US 2003/0075566 A1 Apr. 24, 2003

Related U.S. Application Data

(60) Provisional application No. 60/345,043, filed on Oct. 20, 2001.

(51) Int. Cl.
*B65D 83/00* (2006.01)

(52) U.S. Cl. ..... 222/400.7; 222/318; 137/563

(58) Field of Classification Search ..... 222/95, 222/105, 318, 400.7; 137/563, 588
See application file for complete search history.

(56) References Cited

U.S. PATENT DOCUMENTS 2,150,673 A * 3/1939 De Steffan ..... 222/318
3,464,435 A * 9/1969 Lamb et al. ..... 222/400.7
4,784,299 A * 11/1988 Stenger ..... 222/397
4,785,973 A * 11/1988 Kobe ..... 222/400.7
5,108,015 A * 4/1992 Rauworth et al. ..... 222/400.7
5,148,208 A * 9/1992 Klosterboer et al. ..... 222/318
5,957,328 A * 9/1999 Osgar ..... 222/318
6,015,068 A * 1/2000 Osgar et al. ..... 222/400.7
6,048,113 A * 4/2000 Van den Bergen et al. . 222/318
6,079,597 A * 6/2000 Rauworth et al. ..... 222/400.7
6,206,240 B1 * 3/2001 Osgar et al. ..... 222/389
6,223,955 B1 * 5/2001 Till ..... 222/400.7
6,425,502 B1 * 7/2002 Rauworth et al. ..... 222/400.7

* cited by examiner

*Primary Examiner*—Michael Mar
*Assistant Examiner*—Melvin A Cartagena
(74) *Attorney, Agent, or Firm*—Steven J. Hultquist; Intellectual Property Technology Law; Margaret Chappuis

(57) ABSTRACT

The present invention relates to apparatus and method for re-circulating high viscosity liquids. The apparatus comprises a recirculating probe coupled to a fluid storage and dispensing vessel by a connector, and the recirculating probe comprises: (a) a dip tube defining an output flow path; (b) an output port; (c) a recirculating port; and (d) a return flow path. The output flow path and the return flow path preferably have substantially equal cross-sectional areas, which reduce or eliminate the unbalance between the discharge pressure in the output line and that in the re-circulation line, and prevent premature wearing-out of the dispensing/recirculating pump. The output flow path and the return flow path can also be concentric to each other, which not only maximizes the effective flow area for both output and return flow paths within the limited cross-sectional area of the opening of the fluid vessel, but also avoids liquid turbulence and/or formation of air bubbles caused by free-fall drip introduction of the re-circulated liquid that is commonly observed in conventional recirculating probe designs.

20 Claims, 8 Drawing Sheets

APPARATUS AND METHOD FOR DISPENSING HIGH-VISCOSITY LIQUID

CROSS-REFERENCE TO RELATED APPLICATION

This claims the priority of U.S. Provisional Patent Application No. 60/345,043 filed Oct. 20, 2001 in the names of Kevin T. O'Dougherty

BACKGROUND OF THE INVENTION

1. Field of Invention

The present invention generally relates to apparatus and method for dispensing a process liquid characterized by a high viscosity and a short shelf life.

2. Related Art

Semiconductor manufacturing processes frequently employ process liquids of high viscosity, such as polyimides (typically having a viscosity of 250–35,000 centipoises), which exhibit a good combination of thermal stability, mechanical toughness and chemical resistance and can be used as protective overcoats, interlayer dielectrics, or passivation layers in microelectronic applications. Due to their high viscosity, these process liquids are usually dispensed from pressurized storage and dispensing vessels, by special dispensing pumps in conjunction with large diameter tubing (e.g., 0.9525 cm, 0.375 inch diameter).

A recirculation loop downstream of the dispensing pump is usually provided to keep the high viscosity process liquid in continuous fluidic motion at a desired flow rate. Such a recirculation loop reduces solidification of the liquid (e.g., gel slug formation) inside the dispensing lines, prolongs the shelf life of such liquid, and provides a means for purging air out of the dispensing lines. The recirculation loop usually comprises a three-way dispensing/recirculating valve, a recirculating line, and a recirculating probe coupled to the fluid vessel, for re-circulating the high-viscosity process liquid back into such vessel.

Conventional recirculation probes comprise an output flow path connected to an output port, and a return flow path connected to a recirculating port. A process liquid flows out of the fluid vessel via the output flow path and the output port, and re-circulated process liquid flows back into the fluid vessel via the recirculating port and the return flow path. Typically, the cross-sectional flow area of the return flow path is much smaller than that of the output flow path. Therefore, when the output liquid volume is substantially equal to the re-circulated liquid volume (as usually occurs when purging gas out of the dispensing lines), such difference in cross-sectional flow areas of the output and return flow paths causes an imbalance of discharge pressures in the dispensing line and in the recirculating line. This imbalance unduly burdens the dispensing pump and the dispensing/recirculating valve and causes the pump and the valve to wear out prematurely.

Moreover, conventional recirculation probes feature separate tubing for the output flow path and the return flow path. Such separate tubing configuration does not effectively use the limited cross-sectional area of the opening of the fluid storage and dispensing vessel.

Further, the return flow path of conventional re-circulation probes terminates right below the neck portion of the fluid vessel, in order to minimize the inner surface area of the return flow path and to reduce the head losses caused by the flow resistance of the inner surface of the return flow path. However, such design leaves a free space between the end of the return flow path and the liquid surface within the fluid vessel, and the re-circulated liquid therefore drips in a free-fall manner from the return flow path into the fluid vessel, causing liquid turbulence and deleterious formation of air bubbles in the fluid vessel.

It is therefore one object of the present invention to reduce or eliminate the pressure imbalance between the dispensing line and the recirculating line, so as to prolong the useful life of the dispensing pump and the dispensing/recirculating valve.

It is another object of the present invention to effectively use the limited cross-sectional area of the opening of the fluid storage and dispensing vessel, and to concurrently maximize the effective flow area of the output and return flow paths.

It is still another object of the present invention to provide a smooth flow of the re-circulated fluid back into the fluid storage and dispensing vessel, so as to reduce liquid turbulence and formation of air bubbles in such vessel, without significantly increasing the inner surface area of the return flow path.

It is a still further object of the present invention to provide a liquid recirculating system with changeable liquid outflow ports and/or recirculation ports, and to enable sealed dispensing of high-viscosity liquids that eliminates exposure of such liquids to airborne contaminates and eliminates exposure of personnel to the hazardous fumes of such liquids.

Other objects and advantages will be more fully apparent from the ensuing disclosure and appended claims.

SUMMARY OF THE INVENTION

The present invention significantly reduces or eliminates the pressure imbalance between the output flow path and the return flow path, by providing an apparatus for dispensing a liquid from a fluid storage and dispensing vessel to a liquid dispensing system. Such apparatus comprises a recirculating probe and a connector for coupling said recirculating probe to an opening of the fluid storage and dispensing vessel, and the recirculating probe comprises:

- a dip tube defining an output flow path, wherein the dip tube has a first end and a second end, and wherein the first end of the dip tube extends into the storage and dispensing vessel through the opening;
- an output port coupled to the second end of the dip tube, wherein the liquid from the fluid storage and dispensing vessel flows through the output flow path of the dip tube and the output port to the liquid dispensing system;
- a recirculating port, constructed and arranged to receive re-circulated liquid from the liquid dispensing system; and
- a return flow path coupled to the recirculating port for flowing the re-circulated liquid back into the fluid storage and dispensing vessel, wherein the return flow path has a cross-sectional area that is substantially equal (100%±20%) to the cross-sectional area of the output flow path.

When the return flow path has a cross-sectional area substantially equal to that of the output flow path, the discharge pressures in the output flow path and the return flow path are substantially the same, so the pressure imbalance between the output flow path and the return flow path is reduced or eliminated.

Another aspect of the present invention relates to an apparatus for dispensing a liquid from a fluid storage and dispensing vessel to a liquid dispensing system. Such apparatus comprises a recirculating probe and a connector for coupling said recirculating probe to an opening of the fluid storage and dispensing vessel, while the recirculating probe comprises:

- a dip tube defining an output flow path, wherein the dip tube has a first end and a second end, and wherein the first end of the dip tube extends into the storage and dispensing vessel through the opening;
- an output port coupled to the second end of the dip tube, wherein the liquid from the fluid storage and dispensing vessel flows through the output flow path of the dip tube and the output port to the liquid dispensing system;
- a recirculating port, constructed and arranged to receive re-circulated liquid from the liquid dispensing system; and
- a return flow path coupled to the recirculating port for flowing the re-circulated liquid back into the fluid storage and dispensing vessel, wherein the output flow path and the return flow path are concentric, being separated by the dip tube.

Such concentric design maximizes the effective flow area of the output and return flow paths within the dimensional constraint of the vessel opening.

In a preferred embodiment of the present invention, the return flow path is defined and bounded by an outer wall of the dip tube, so that when the re-circulated liquid flows from the recirculating port into the return flow path, the re-circulated fluid contacts the outer wall of the dip tube, and flows down such dip tube into the fluid storage and dispensing vessel. In such manner, the dip tube concurrently functions as a flow-directing tube for the re-circulated liquid flow. The re-circulated liquid flow directed by the dip tube according to the present invention demonstrates significantly reduced splashing or turbulence and minimizes formation of air bubbles in the liquid, in comparison with the free-fall dripping of the re-circulated liquid in the conventional recirculating probes.

In another preferred embodiment of the present invention, the recirculating probe comprises detachable output port and return port, for ready replacement of damaged ports, and ease of cleaning of the flow paths of such recirculating probe.

In a still further embodiment of the present invention, the recirculating probe comprises two O-ring seals, one disposed between the dip tube and the output port, and the other disposed between the recirculating probe and the opening of the fluid storage and dispensing vessel. This arrangement completely seals the output flow path and the fluid vessel, eliminates exposure of the dispensed liquid to airborne contaminates, and prevents exposure of personnel to the hazardous fumes of such dispensed liquid.

A further aspect of the present invention relates to methods of dispensing a high-viscosity liquid from a fluid storage and dispensing vessel, using the apparatuses described hereinabove.

As used herein, the term "high-viscosity liquid" refers to a liquid that has a viscosity of at least 50 centipoises. More preferably, such liquid has a viscosity of at least 100 centipoises, and most preferably at least 1000 centipoises. For example, the high-viscosity liquid may have a viscosity in a range of from about 50 to about 100,000 centipoises. The liquid viscosity values as set out herein are measured at 25° C. by a Brookfield viscometer, using a No. 2 spindle and at a shear rate of 300 rpm).

The high-viscosity liquid may be a process liquid useful in a semiconductor manufacturing process, such as polyimide resin. Alternatively, such liquid may be a process liquid useful in pharmaceutical processes, such as liquids used in DNA synthesizers, peptide synthesizers, and other liquid reagents widely used in industrial processes. The exemplary liquids listed here are merely illustrative and are not intended to limit the broad scope of the present invention.

Additional aspects, features and embodiments of the invention will be more fully apparent from the ensuing disclosure and appended claims.

DETAILED DESCRIPTION OF THE INVENTION, AND PREFERRED EMBODIMENTS THEREOF

Figure 1:
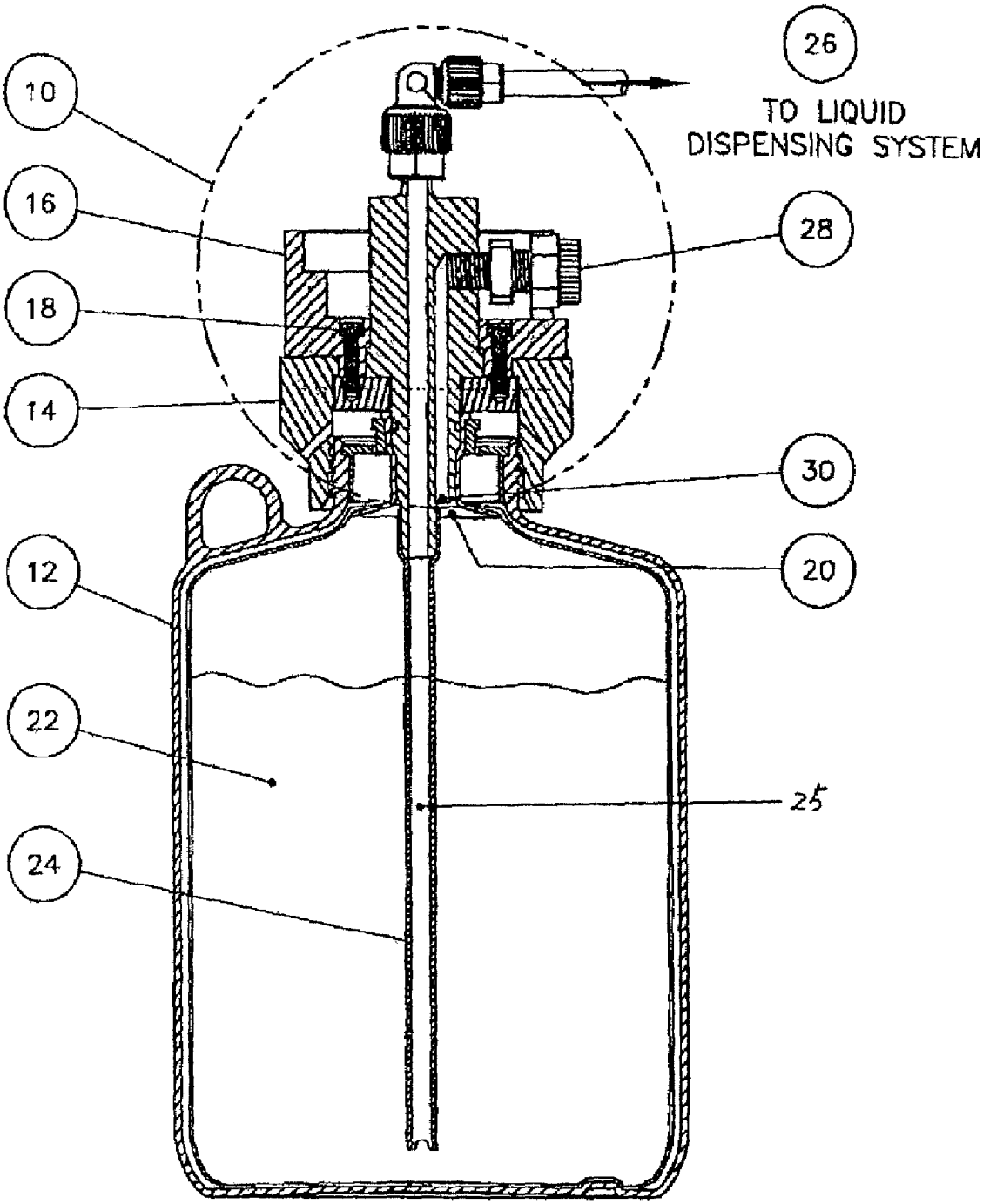
Figure 1 (Prior Art)
FIG. 1 ("Prior Art") shows a conventional recirculating probe, as connected to a fluid storage and dispensing vessel.

FIG. 1 ("Prior Art") shows a conventional recirculating probe 10 coupled to opening 20 of a fluid storage and dispensing vessel 12, by a lower connector 14 and an upper connector 16. The lower connector 14 and the upper connector 16 are fastened together by a screw-type fastener 18. The recirculating probe 10 comprises a dip tube 24 that defines an output flow path 25. The upper end of the dip tube 24 is connected with an output port, for flowing a high-viscosity liquid 22 stored by the fluid storage and dispensing vessel 12 through to a liquid dispensing system 26. In order to maintain a continuous flow of the liquid 22 and to prevent gel slug formation within the dispensing lines, the diameter of the dip tube 24 is relatively large (e.g., on the order of 0.9524 cm, 0.375 inch), and the liquid 22 is flowed at a relatively high flow rate. At least a majority percentage of the liquid 22 dispensed to the liquid dispensing system 26 is re-circulated back into the fluid storage and dispensing vessel 12 via a re-circulating port 28. The recirculating port 28 is connected to a return flow path 30 including an opening within the storage and dispensing vessel 12. The diameter of the return flow path 30 is generally within a range of from about 0.4318 cm, 0.17" to about 0.4826 cm, 0.19" inch.

There are several problems related to the conventional design of the recirculating probe.

Figure 3A:
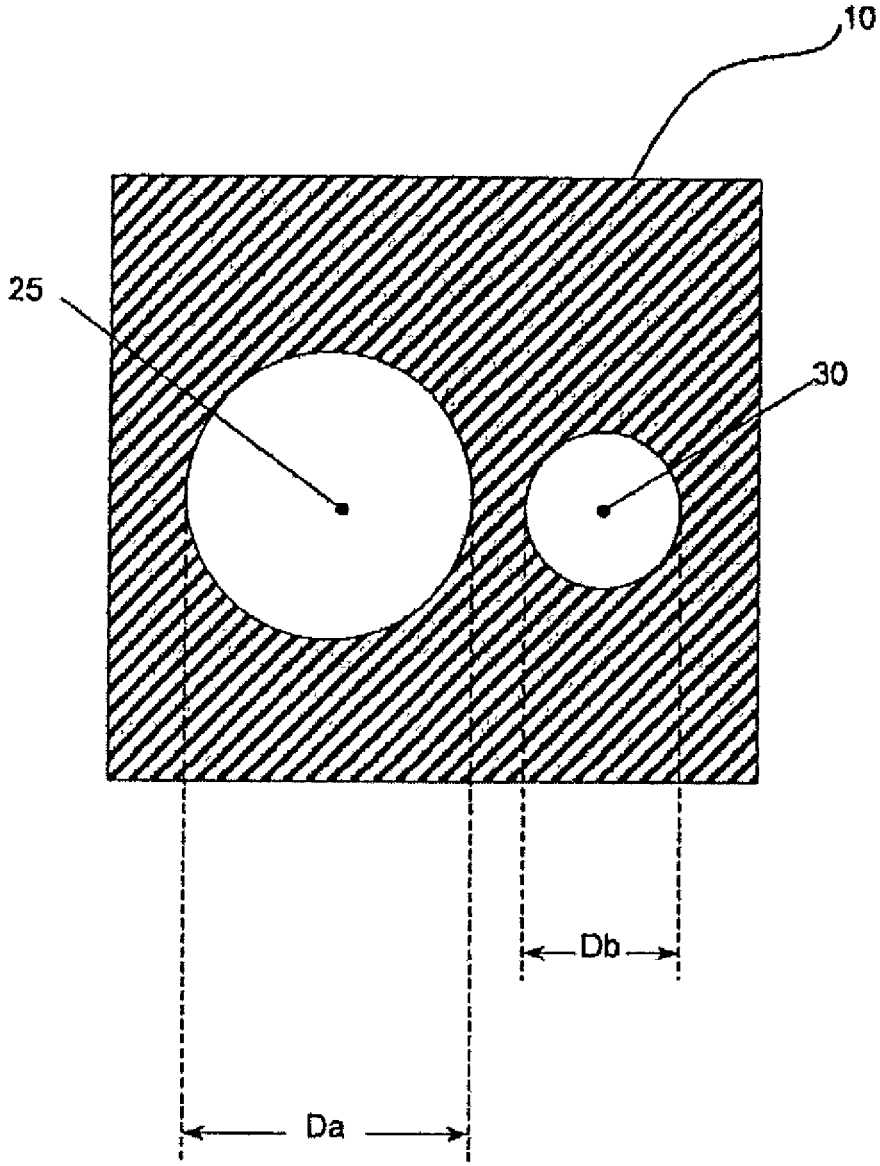
Figure 3A (Prior Art)
FIG. 3A is a simplified cross-sectional view of the output flow path and the return flow path, as configured in the conventional recirculating probe of FIG. 1.

First, as shown in FIG. 3A, the output flow path 25 has a diameter (0.9525 cm, 0.375") (Da) that is much larger than the diameter (0.4318 cm, 0.17") (Db) of the return flow path 30. Therefore, the output flow area ($=\pi*(Da/2)^2$) is much larger than the return flow area ($=\pi*(Db/2)^2$). When the recirculating probe is used for purging gas out of the dispensing line, the output liquid volume is approximately the same as the re-circulated liquid volume. Given the difference between the output flow area and the return flow area, the discharge pressure within the re-circulating line is much higher than the discharge pressure within the dispensing line, resulting in a pressure imbalance in the dispensing pump and in the dispensing/recirculating valve of the liquid dispensing system, which in turn leads to premature wearing-out of the dispensing pump and the dispensing/recirculating valve.

Figure 2:
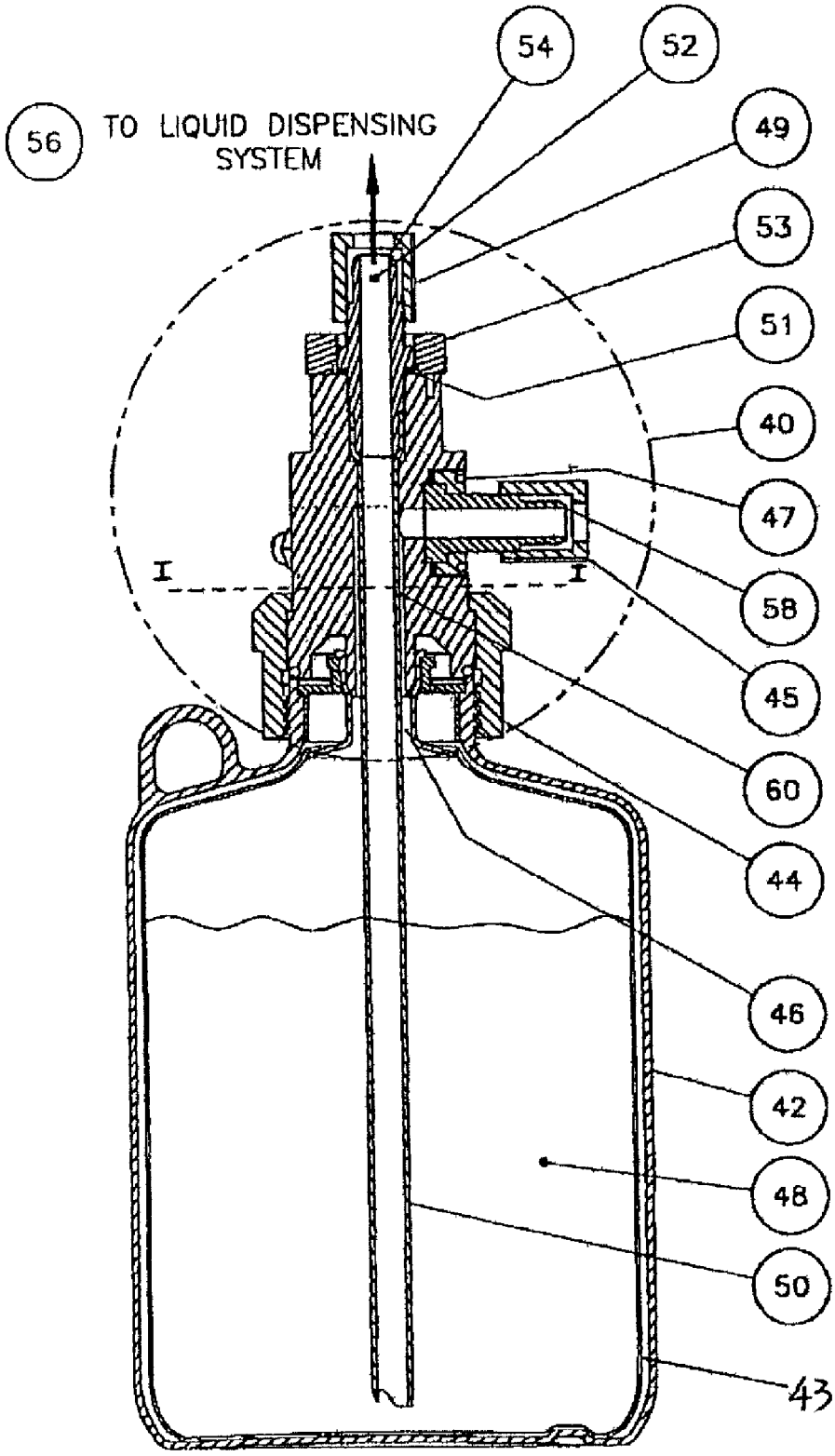
FIG. 2 shows a recirculating probe according to one embodiment of the present invention, as connected to a fluid storage and dispensing vessel.

In order to eliminate such pressure imbalance and to prolong the useful life of the dispensing pump and the dispensing/recirculating valve, the present invention provides a recirculating probe 40, as shown in FIG. 2, for dispensing a high-viscosity liquid from a fluid storage and dispensing vessel 42 to a liquid dispensing system 56. The recirculating probe 40 includes:

(a) an integral connector 44, preferably a one-piece retaining collar, for connecting the recirculating probe 40 to an opening 46 of the fluid storage and dispensing vessel 42, wherein the integral connector 44 is retained on the probe 40 by an attachment nut 47, with the integral design of the connector 44 obviating the need for additional parts or fasteners and simplifying the overall structure of the probe 40;

(b) a dip tube 50 having a first end and a second end and defining an output flow path 52, with the first end of the dip tube extending into the vessel 42;

(c) an output port 54 coupled to the second end of the dip tube 50, so that the liquid 48 stored by the vessel 42 flows through the output flow path 52 within the dip tube 50 and the output port 54 to a liquid dispensing system 56;

(d) a recirculating port 58, constructed and arranged to receive re-circulated liquid from the liquid dispensing system 56; and (e) a return flow path 60 coupled to the recirculating port 58 for flowing the re-circulated liquid back into the vessel 42.

A primary advantage of the recirculating probe as shown in FIG. 2 is that the return flow path 60 has a cross-sectional area that is substantially equal to the cross-sectional area of the output flow path 52. As used herein, the phrase "substantially equal to" indicates a difference between the cross-sectional areas of the output flow path and the return flow path that is less than 5% of the total cross-sectional area of the output flow path. Therefore, the cross-sectional area of the return flow path is 100%±5% of the cross-sectional area of the output flow path.

Figure 3B:
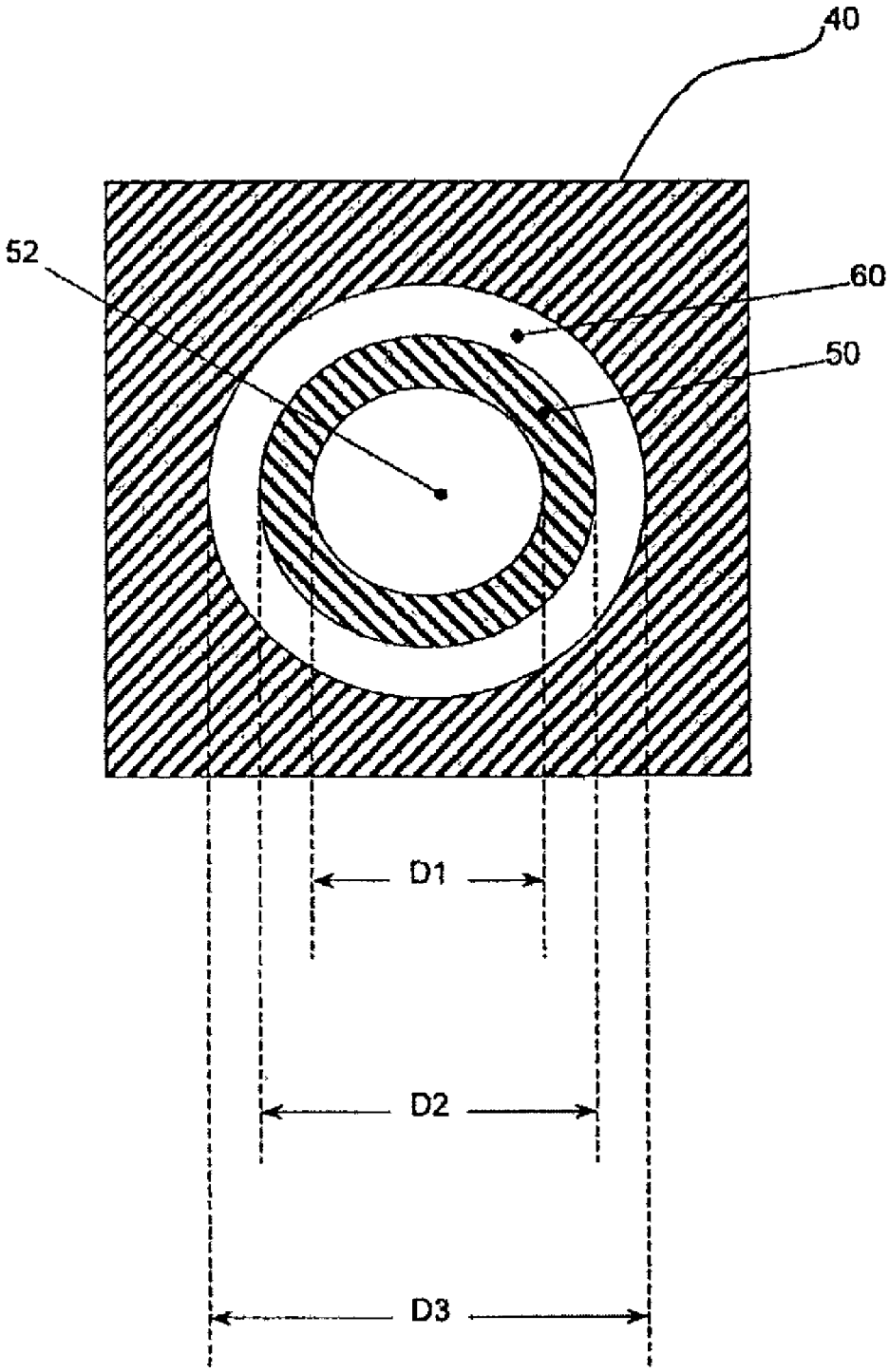
FIG. 3B is a simplified cross-sectional view of the output flow path and the return flow path, as configured in the recirculating probe of FIG. 2.

FIG. 3B shows a cross-sectional view of the recirculating probe 40 of FIG. 2, along transverse line I—I. As shown in FIG. 3B, the output flow path 52 is defined by an inner wall of the dip tube 50. The return flow path 60 is an annular passage concentric to and encircling the output flow path 52, wherein the return flow path 60 is defined by an outer wall of the dip tube 50 and an inner wall of the recirculating probe 40. The diameter of the output flow path 52 (D1) equals the inner diameter of the dip tube 50. The inner diameter of the return flow path 60 (D2) equals the outer diameter of the dip tube 50, and the outer diameter of the return flow path 60 (D3) equals the inner diameter of the recirculating probe 40.

Therefore, the output flow area OA, which is the cross-sectional area of the output flow path 52, equals $$\pi\times\left(\frac{D_1}{2}\right)^2.$$

The return flow area RA, which is the cross-sectional area of the return flow path 60, equals $$\pi\times\left(\frac{D_3}{2}\right)^2-\pi\times\left(\frac{D_2}{2}\right)^2.$$

According to the present invention, RA is designed to be substantially equal to OA (i.e., RA=100% OA with ±5% deviation), for purpose of minimizing pressure imbalance between the dispensing line and the recirculating line and reducing wear on the dispensing pump and the dispensing/recirculating valve.

In an illustrative preferred embodiment of the present invention, 0.889 cm, 0.35 inch≦D1≦1.143 cm, 0.45 inch, preferably D1=0.9525 cm, 0.375 inch, 1.143 cm, 0.45 inch≦D2≦1.397 cm, 0.55 inch preferably D2=1.27 cm, 0.5 inch, and 1.524 cm, 0.60 inch≦D3≦1.651 cm, 0.65 inch, preferably D3=1.5875 cm, 0.625 inch. Preferably, both the output flow area and the return flow area are approximately 0.7122 $cm^2$, 0.1104 square inch.

It is also within the scope of the present invention to use output flow path and return flow path configurations that are not concentric, as long as the output flow area is substantially equal to the return flow area.

A second independent advantage of the present invention relates to the preferred concentric design of the output flow path and return flow path, which maximizes the effective flow area of such paths for a given total cross-sectional area of the vessel opening. The conventional non-concentric design of the output flow path and return flow path, as shown in FIG. 3A, leaves substantial unused opening area and does not effectively use the available cross-sectional area of the vessel opening for liquid flow.

In the conventional recirculating probe 10 as shown in FIG. 1, the return flow path 30 is defined by a tube that is separate from the dip tube 24 defining the output flow path 25. The return flow path 30 terminates right below the neck portion of the fluid vessel 12. Such design is important for minimizing the inner surface area of the return flow path 30 in order to reduce the head losses caused by the flow resistance of the inner surface of the return flow path 30, and to minimize wear on the re-circulation pump. However, such design leaves a free space between the end of the return flow path 30 and the liquid surface within the fluid vessel 12. As a result, the re-circulated liquid drips from the return flow path 10 into the liquid 22 in the fluid vessel 12 in a free-fall manner. Such dripping inevitably causes splashing or turbulence in the liquid 22, and leads to deleterious formation of air bubbles therein.

In order to overcome the above-described problems, the recirculating probe 40, as shown in FIG. 2 according to an illustrative embodiment of the present invention, employs an annular return flow path 60 that encircles the dip tube 50, wherein such annular return flow path 60 is directly defined by the outer wall of the dip tube 50.

When re-circulated liquid enters the return flow path 60 from the recirculating port 58, such re-circulated liquid annularly spreads around the outer wall of the dip tube 50 and flows smoothly down the outer wall of the dip tube 50 into the fluid vessel 42. Thus, the dip tube 50 performs dual functions in the present invention: (1) it defines the output flow path 52 for flowing liquid 48 out of the fluid storage and dispensing vessel 42; (2) it directs the flow of re-circulated liquid back into the fluid storage and dispensing vessel 42. As shown in FIG. 2, the return flow path 60 still terminates right below the neck portion of the vessel 42, with minimum inner surface area. However, the re-circulated liquid entering the return flow path 60 will no longer free-fall drip into the vessel 42 after the termination of the return flow path 60; instead, the re-circulated liquid will smoothly flow down the dip tube 50 into the vessel 42. The flow of re-circulated liquid in the present invention, as being directed by the dip tube 50, causes much less liquid turbulence and formation of air bubbles in the liquid, in comparison to the free-fall dripping of re-circulated liquid in the conventional design, which constitutes an additional advantage of the present invention.

The re-circulation probe of the instant invention may be manufactured from any polymeric material having characteristic high purity and good thermal stability. Preferably, the recirculation probe is manufactured from Teflon® PFA 445 HP polymer available from DuPont Fluoroproducts, Wilmington, Del. The Teflon® PFA 445 HP polymer is characterized by high purity and good thermal stability (having a melting point of from about 302° C. to about 310° C., which enables melt extrusion of the perfluoroalkoxy resin at temperatures from about 350–400° C., preferably at a temperature of about 390° C.). Use of the high purity PFA 445 polymer for the recirculation probe body significantly reduces contamination of the processing liquid.

Regarding the fluid storage and dispensing vessel, the present invention utilizes a "bag-in-a-bottle" design, for easy recycling of such vessel and for non-contact pressurization of the liquid in such vessel.

Specifically, the high-viscosity liquid 48 is stored in a liner 43 located in the fluid storage and dispensing vessel 42. Between the liner 43 and the fluid vessel 42, there presents a liquid-free space, to which pressurized gas can be introduced. Because the liner 43 is fabricated of a relatively flexible and deformable material (such as an elastomer or polymer), the pressurized gas so introduced indirectly applies pressure to the liquid 48 through the liner 43 to facilitate dispensing of the liquid 48, but without direct contact to the liquid 48 (i.e., the pressurized gas is isolated from the liquid 48 by liner 43 ). Therefore, the present invention effectively avoids contamination of the process liquid by the pressurized gas, and reduces outgassing and formation of micro-bubbles due to dissolution of the pressurized gas into the liquid under high pressure.

The liner 43 can be fabricated of any deformable elastomeric or polymeric material that has sufficient thermal stability and does not deleteriously interact with the liquid contained therein. Preferably, the liner is made of one or more fluoropolymers, such as perfluoroalkoxy-based polymers and polytetrafluoroethylene resins, etc. Suitable liner materials include but are not limited to perfluoroalkoxy resin (PFA), PTFE, Nylon, Polyethylene, ECTFE Poly/nylon, polyethylene, and PFA/PTFE, and combinations thereof.

Figure 4A:
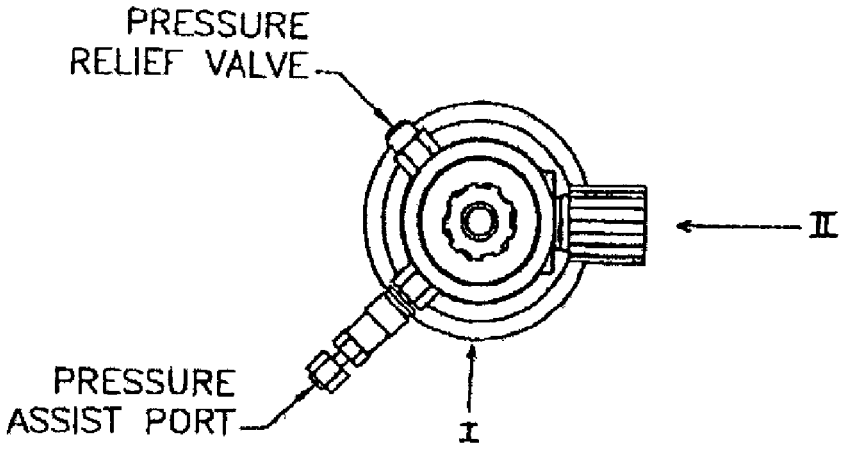
FIGS. 4A–C show various views of the recirculating port, the pressure assist port, and the pressure relieve valve of a recirculating probe according to one embodiment of the present invention.
Figure 4B:
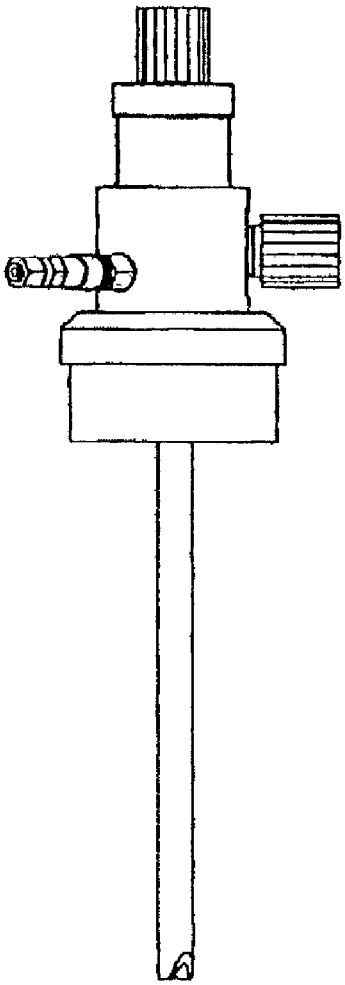
Figure 4C:
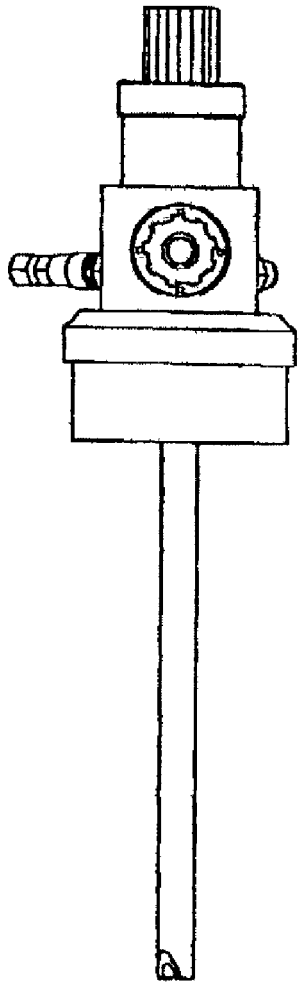

The pressurized gas as described hereinabove can be introduced from an external pressure source (not shown) into the storage and dispensing vessel 42, via a pressure assist port. After the liquid 48 is dispensed, the internal pressure inside the container, where chemical resides can be reduced by disconnecting the quick disconnect pressurization fitting as shown in FIGS. 4A–C.

A pressure relief valve on the container (not shown) functions to prevent an overpressure condition within the bottle (or between the outside layer of the liner and the inside wall of the bottle) when air pressure is being applied to the liner to help in the dispensing of the chemical.

The no-contact pressure dispensing of liquids, as described hereinabove, reduces the mechanical load on the dispensing pump of the liquid dispensing system 56 and prolongs the useful life of such pump, without increasing the risk of contamination of the process liquids.

In another preferred embodiment of the present invention, the output port 54 is detachably coupled to the dip tube 50 by the output flowpath fitting which may be threaded into the recirculation probe body and an integral flowpath fitting locking collar 53, and/or the recirculating port fitting 58, is detachably coupled to the return flow path 60 by a nut 47, so that either or both of the output and recirculating port fittings can be detached from the recirculating probe 40. Such detachable coupling allows easy and quick replacement or removal of the output and/or recirculating ports, e.g., in case that such ports are damaged and need to be replaced, or when it is necessary to clean the flow paths inside the recirculating probe 40.

The replaceable output port fittings and recirculation port fittings provide for built in fitting modularity as they are readily changeable for easy hook up of varying size diameter tubings. Such modularity provides for significant savings to the user as one re-circulation probe accommodates tubing sizes such as ¼ O.D., ⅜ O.D., or ½ O.D and combinations thereof.

The integral locking collar prevents rotation of the output fitting by having a top half of the collar fitting tightly over the hex end of the fitting, and the bottom half of the collar being "pinned" into the top surface of the recirculation probe body. This locking is achieved with out the need for additional tools or parts. It relies on close tolerance "slip fits" for all mating parts.

The sealing connection between the output port fitting 54 and the diptube 50 is made when the tapered/radiused mating surfaces of each item come into contact with each other. This normally precludes any liquid from traveling up the threaded portion of the output port fitting 54 and leaking from the recirculation probe body. Optionally; a secondary seal such as an O-ring 51 may be incorporated into the sealing connection to further prevent leakage of liquid 48 from such connection.

Figure 5:
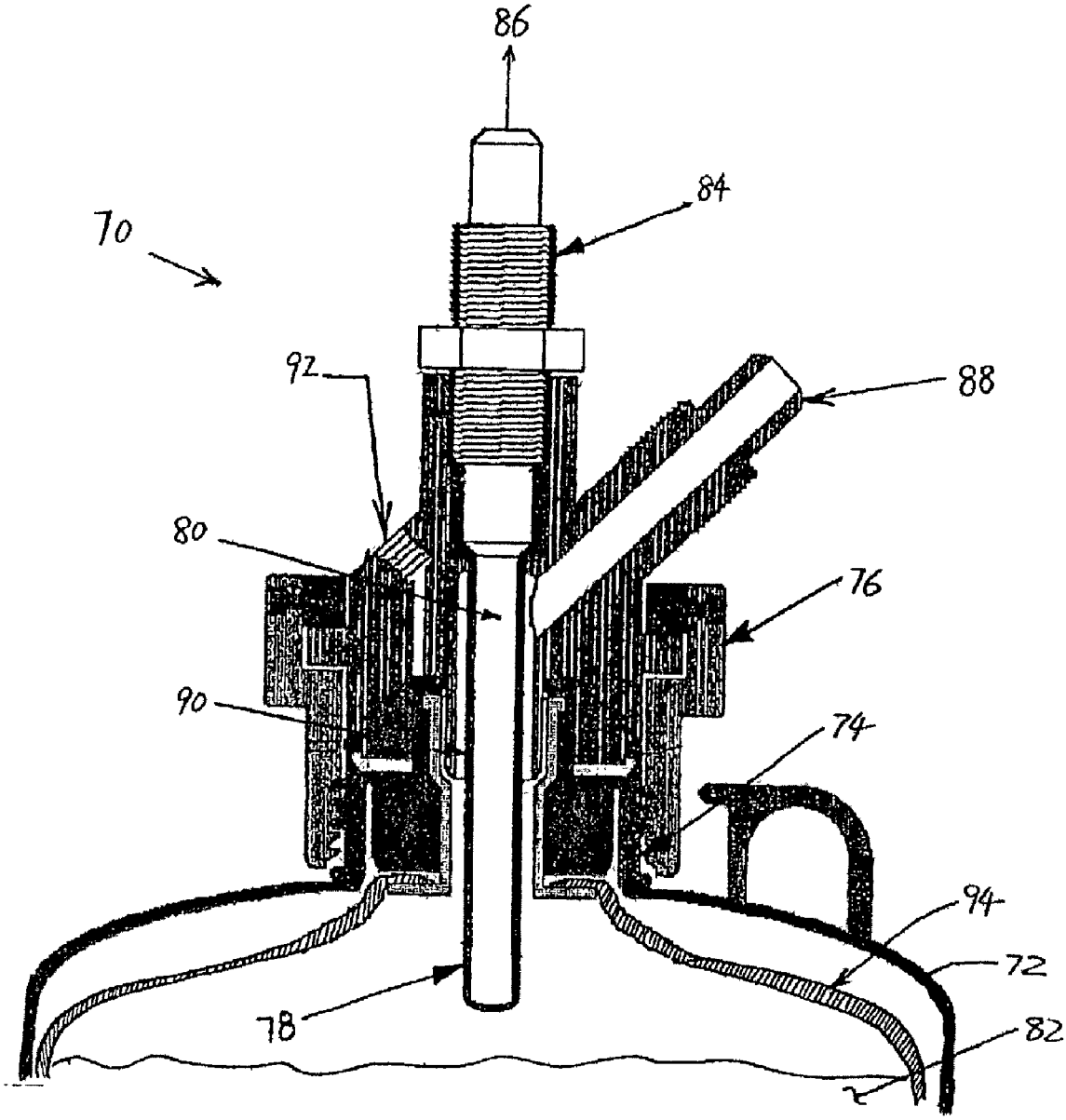
FIG. 5 shows a recirculating probe according to another embodiment of the present invention, as connected to a fluid storage and dispensing vessel.

FIG. 5 shows a recirculating probe 70 according to another embodiment of the present invention, as coupled to a fluid storage and dispensing vessel 72. The recirculating probe 70 in such embodiment is coupled to the neck 74 of the fluid vessel 72, and held in place by a multi-piece connector 76. The recirculating probe 70 comprises a dip tube 78 that defines an output flow path 80 for a high-viscosity fluid 82 stored in a liner 94 disposed inside the fluid vessel 72. The dip tube 78 is coupled to an output port 84, which in turn is coupled to a liquid dispensing system 86. If needed, the liquid dispensing system 86 can re-circulate high-viscosity fluid 82 back to the fluid vessel 72 via a recirculating port 88. The re-circulate return port 88 is permanently coupled to a return flow path 90. Return flow path 90 desirably has an effective cross-sectional area substantially equal to or greater than the cross-sectional area of output flow path 80.

In the embodiment shown in FIG. 5, both the output port 84 and the recirculating port 88 are permanently coupled to the recirculating probe 70 to form an integral unit therewith. Such integral connection design has the advantage of enhanced equipment integrity, but it generally incurs higher replacement costs, because each time when a connection port is damaged, the whole recirculating probe has to be replaced.

A pressure-assist port 92 is employed in the recirculating probe 70 for introducing pressurized gas into the space between the outer surface of liner 94 and inner surface of the fluid vessel 72, to facilitate delivery of high-viscosity liquid 82.

Another embodiment of the present invention allows the return flow path and output flow path to have equal cross-sectional areas, without being concentric. For example, the output flow path can have a semi-circular shaped cross-sectional area, while the return flow path can have a complementary semi-circular cross-sectional area of equal or substantially equal size. Any suitable geometry can be used to provide the re-circulate return path with an effective cross-sectional area equal to or greater than that of the output flow path, as readily determinable by a person ordinarily skilled in the art, on the basis of the disclosure herein.

Figure 6:
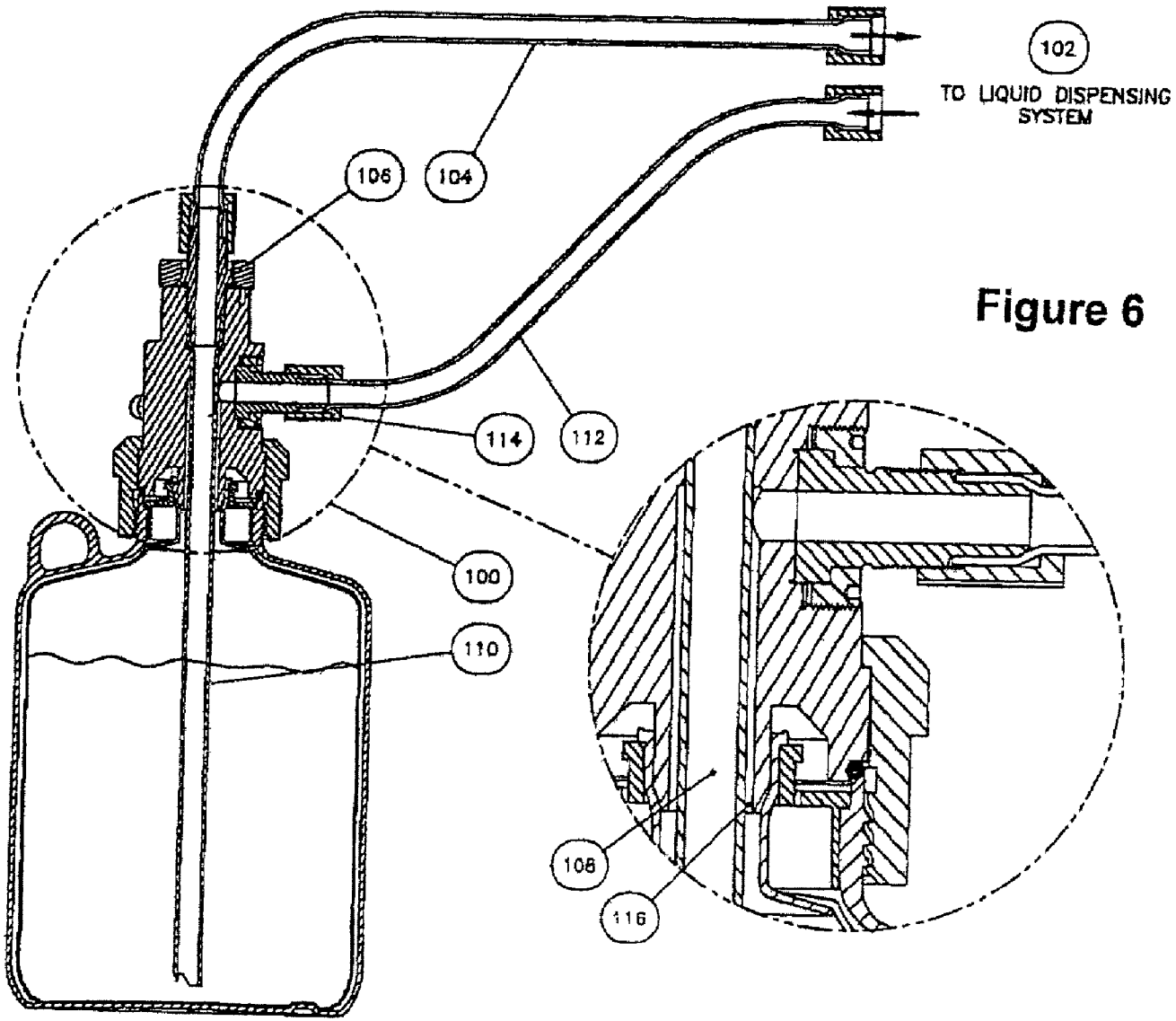
FIG. 6 shows a recirculating probe according to still another embodiment of the present invention, as connected to a dispensing line and a recirculating line.

FIG. 6 shows a re-circulation probe 100 coupled to a liquid-dispensing system 102 via dispensing line 104. The dispensing line 104 is coupled to the output port 106, which in turn is coupled to the output flow path 108 defined by dip tube 110. Recirculating of the high-viscosity liquid is effected via recirculating line 112 to a recirculating port 114, then to an annular return flow path 116 that is concentric to the output flow path 108.

Figure 7:
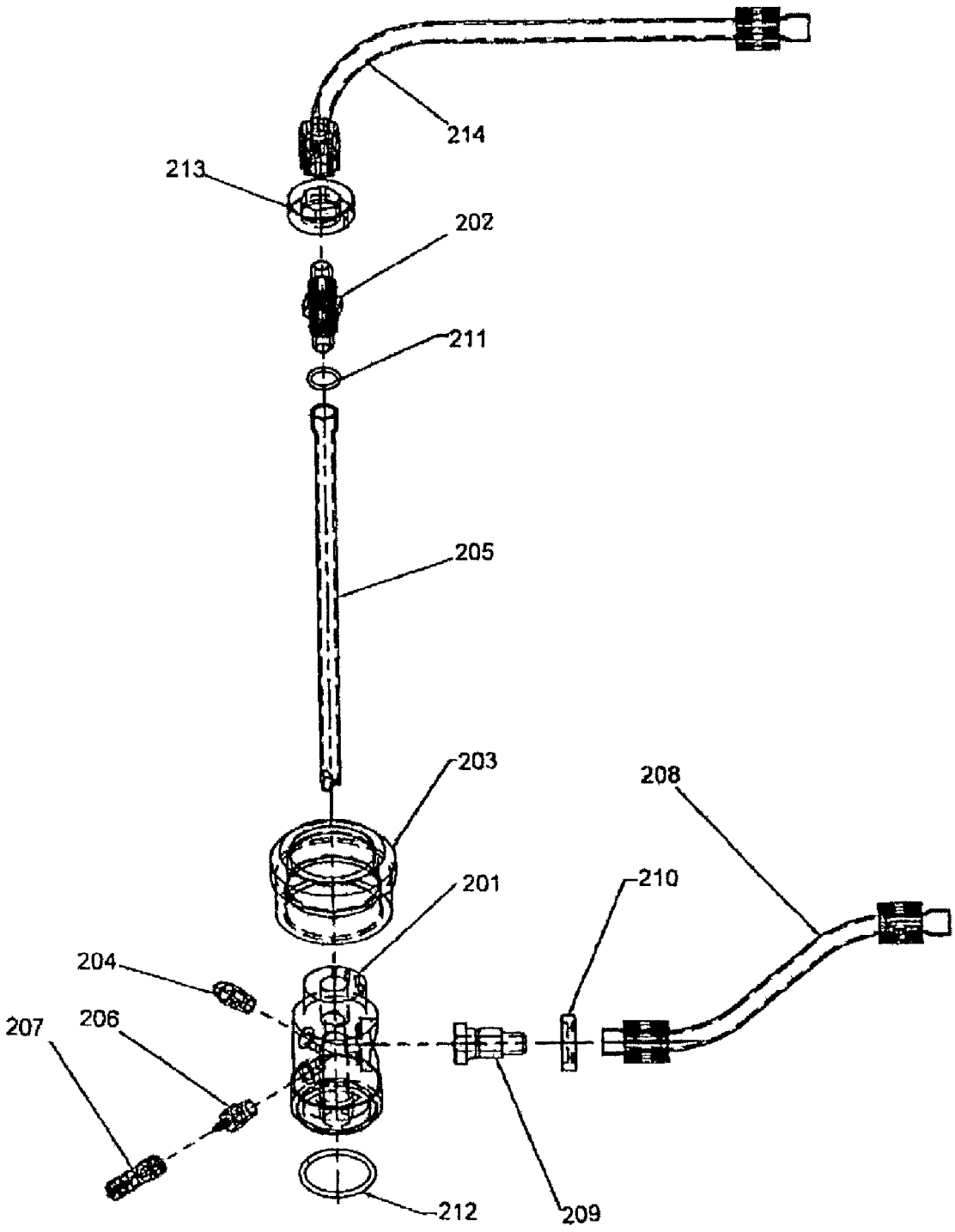
FIG. 7 shows an exploded view of various components of the recirculating probe of the present invention, in one embodiment thereof.

FIG. 7 shows an exploded view of various components of the recirculating probe according to one embodiment of the present invention, comprising a dispensing line 214, an integral locking collar 213, an output port 202, an O-ring seal 211, a dip tube 205, a connector 203, a recirculation probe body 201 of the recirculating probe, another O-ring seal 212, a pressure assist quick disconnect port 207 and associated fitting 206, a pressure relief valve 204, a recirculating line 208, a recirculating port 209 and associated recirculating port retainer nut 210.

The recirculating probe of the present invention provides a simple and cost-effective way for purging gas out of the dispensing line of a process liquid, without inducing significant waste of such process liquid. It also helps to maintain continuous flow motion of a high-viscosity process liquid, such as polyimide and other viscous resins, so as to prevent gel slug formation inside the dispensing line of such process liquid.

Although the invention has been variously disclosed herein with reference to illustrative embodiments and features, it will be appreciated that the embodiments and features described hereinabove are not intended to limit the scope of the invention, and that other variations, modifications and other embodiments will suggest themselves to those of ordinary skill in the art. The invention therefore is to be broadly construed, consistent with the claims hereafter set forth.

What is claimed is:

1. An apparatus for dispensing a liquid from a fluid storage and dispensing vessel to a liquid dispensing system, including a recirculating probe and a connector for coupling said recirculating probe to an opening of the fluid storage and dispensing vessel, said recirculating probe comprising:

a dip tube defining an output flow path, wherein said dip tube has a first end and a second end, and wherein the first end of the dip tube extends into said storage and dispensing vessel through the opening;

an output port coupled to the second end of the dip tube, wherein the liquid from said fluid storage and dispensing vessel flows through the output flow path of the dip tube and the output port to the liquid dispensing system, wherein the outflow path of the dip tube and the output port has an essentially constant width dimension along the length of the path thereby allowing for essentially consistent flow velocity and pressure;

a recirculating port, constructed and arranged to receive re-circulated liquid from said liquid dispensing system; and a return flow path coupled to the recirculating port for flowing the re-circulated liquid downwardly along the dip tube and back into the fluid storage and dispensing vessel, wherein the outflow path is adjacent to the return flow path and extends from the first end of the dip tube to the output port, wherein said return flow path has a cross-sectional area that is substantially equal to the cross-sectional area of said output flow path.

2. The apparatus of claim 1, wherein the return flow path and the output flow path are concentric, being separated by the dip tube.

3. The apparatus of claim 2, wherein the dip tube has an inner diameter within a range of from about 0.889 cm to about 1.143 cm, and an outer diameter within a range of from about 1.143 cm to about 1.397 cm, and wherein the return flow path has an outer diameter within a range of from about 1.524 cm to about 1.651 cm.

4. The apparatus of claim 1, constructed and arranged to dispense a liquid that has a viscosity of at least 50 centipoises.

5. The apparatus of claim 1, constructed and arranged to dispense a liquid that has a viscosity of at least 100 centipoises.

6. The apparatus of claim 1, constructed and arranged to dispense a liquid that has a viscosity of at least 1000 centipoises.

7. The apparatus of claim 1, further comprising a pressure assist port that is coupled to an external pressure source for introducing pressurized gas into the fluid storage and dispensing vessel, to facilitate flow of the liquid from said fluid storage and dispensing vessel to the liquid dispensing system.

8. The apparatus of claim 7, further comprising a pressure relief valve for reducing overpressure within the fluid storage and dispensing vessel.

9. The apparatus of claim 7, wherein the liquid is stored within a liner disposed in said fluid storage and dispensing vessel, wherein a space is present between an outer surface of the liner and an inner wall of said fluid storage and dispensing vessel, and wherein pressurized gas is introduced to said space through the pressure assist port, for pressurizing the liquid stored within said liner without directly contacting said liquid.

10. The apparatus of claim 9, wherein the liner comprises at least one fluoropolymer.

11. The apparatus of claim 9, wherein the liner is fabricated of a material comprising at least one of, perfluoroalkoxy resin (PFA), PTFE, Nylon, Polyethylene, ECTFE, Poly/nylon, polyethylene, PFA/PTFE, and combinations thereof.

12. The apparatus of claim 1, wherein the return flow path is bounded by a vertically aligned outer wall of the dip tube, so that when the re-circulated liquid flows from the recirculating port into the return flow path, said re-circulated liquid comes into contact with the vertically aligned outer wall of the dip tube and is directed by said dip tube to flow vertically downwardly along the outer wall surface into the fluid storage and dispensing vessel.

13. The apparatus of claim 1, wherein the output port is detachably coupled with the dip tube of the recirculating probe.

14. The apparatus of claim 1, wherein the recirculating port is detachably coupled with the return flow path of the recirculating probe.

15. The apparatus of claim 1, wherein the recirculating probe is sealingly coupled to the opening of the fluid storage and dispensing vessel by a first O-ring seal.

16. The apparatus of claim 15, wherein the output port is sealingly coupled to the second end of the dip tube by a secondary/backup O-ring seal.

17. The apparatus of claim 1, wherein the output port is coupled to the second end of the dip tube by an integral locking collar.

18. The apparatus of claim 1, wherein the liquid dispensing system dispenses liquid to a downstream semiconductor processing system.

19. An apparatus for dispensing a liquid from a fluid storage and dispensing vessel to a liquid dispensing system, comprising a recirculating probe and a connector for coupling said recirculating probe to an opening of the fluid storage and dispensing vessel, said recirculating probe comprising:

a dip tube having a vertically aligned inner and outer wall defining an output flow path, wherein said dip tube has a first end and a second end, and wherein the first end of the dip tube extends into said storage and dispensing vessel through the opening, wherein the outflow path of the dip tube and the output port has an essentially constant width dimension along the length of the path thereby allowing for essentially consistent flow velocity and reduced agitation of the liquid;

an output port coupled to the second end of the dip tube, wherein the liquid from said fluid storage and dispensing vessel flows through the output flow path of the dip tube and the output port to the liquid dispensing system;

a recirculating port, constructed and arranged to receive recirculated liquid from said liquid dispensing system; and a vertically aligned return flow path coupled to the recirculating port and defined by the outer wall of the dip tube for flowing the re-circulated liquid vertically downward along the outer wall and back into the fluid storage and dispensing vessel, wherein the outflow path is adjacent to the return flow path and extends from the first end of the dip tube and above the return flow path to the output port, wherein said output flow path and said return flow path are concentric, being separated by the dip tube.

20. The apparatus of claim 19, wherein the return flow path is bounded by the outer wall of the dip tube, so that when the re-circulated liquid flows from the recirculating port into the return flow path, said re-circulated liquid comes into contact with the outer wall of the dip tube and is directed by said dip tube to flow vertically downwardly into the fluid storage and dispensing vessel.

* * * * *